US006111497A

United States Patent [19]

Andersson et al.

[11] Patent Number: 6,111,497

[45] Date of Patent: Aug. 29, 2000

[54] BUZZER WITH ZENER DIODE IN DISCHARGE PATH

[75] Inventors: Hakan Andersson, Malmo; Bo Ekdahl, Staffanstorp, both of Sweden

[73] Assignee: Telefonaktiebolaget LM Ericsson, Stockholm, Sweden

[21] Appl. No.: 09/266,792

[22] Filed: Mar. 12, 1999

[51] Int. Cl.[7] ..... M01M 37/04

[52] U.S. Cl. ..... 340/384.1; 340/384 E; 340/384 R; 361/160; 381/104; 324/145; 84/1.24

[58] Field of Search ..... 340/384.1, 384 E, 340/384 R; 361/160; 381/104; 324/145; 84/1.24

[56] References Cited

U.S. PATENT DOCUMENTS

| | | | |
|---|---|---|---|
| 4,163,223 | 7/1979 | Sato et al. | 340/384 R |
| 4,183,278 | 1/1980 | Rea et al. | 84/1.24 |
| 4,797,932 | 1/1989 | Rohulich et al. | 381/104 |
| 5,293,149 | 3/1994 | Wilson et al. | 340/384 E |
| 5,481,185 | 1/1996 | Lane et al. | 324/145 |
| 5,596,477 | 1/1997 | Horton | 361/160 |

FOREIGN PATENT DOCUMENTS

| | | | |
|---|---|---|---|
| 0 450 666 | 10/1991 | European Pat. Off. | G01K 9/13 |
| 0 884 719 | 12/1998 | European Pat. Off. | G10K 9/15 |
| 2 280 260 | 2/1976 | France | H03K 17/64 |
| 24 52 023 | 5/1976 | Germany . | |
| 55-145037 | 11/1980 | Japan | B60Q 5/00 |
| 61-154338 | 7/1986 | Japan | H04M 1/00 |
| 1072822 | 6/1967 | United Kingdom | G01R 31/02 |

OTHER PUBLICATIONS

S.M. Sze, "Semiconductor Devices: Physics and Technology", John Wiley & Sons, Apr. 1985, pp. 83–84, 89, 98, 507–508, 512.

*Primary Examiner*—Daniel J. Wu
*Assistant Examiner*—Tai T. Nguyen
*Attorney, Agent, or Firm*—Burns, Doane, Swecker & Mathis, L.L.P.

[57] ABSTRACT

A relatively high voltage is developed across a buzzer by placing a resistance in the discharge path of an buzzer, e.g., by shunting one or more Zener diodes or LEDs across a switching transistor, the switching transistor being connected in series with the buzzer between a voltage potential and ground. Alternatively, the buzzer is shunted with a resistive element, with or without series connected a reversed biased diode. The result is a higher audio output without a corresponding increase in power consumption.

20 Claims, 7 Drawing Sheets

BUZZER WITH ZENER DIODE IN DISCHARGE PATH

BACKGROUND OF THE INVENTION

1. Field of the Invention

The present invention relates to a driver circuit for an audible indicator and in particular for a buzzer controlled by a transistor.

2. Discussion of Related Art

Buzzers are used for a wide variety of indicators including toys, cellular telephones, pagers and other communication devices and other miscellaneous and asundry devices which require an audible indicator. The buzzers of course require driver circuits.

One such prior art driver circuit it shown in FIG. 1. FIG. 1 consists of a driver circuit 10 which includes a buzzer 11 a bipolar or field effect transistor 12. The buzzer 11 and the transistor 12 are connected in series between a voltage potential $V_{DD}$ of, e.g., 6.2 volts, and ground. Connected in parallel to the buzzer 11 are two parallel connected diodes 13 and 14. The cathodes of the diodes 13 and 14 are connected to the voltage source $V_{DD}$ and the anodes of the diodes 13 and 14 are connected to the node 1 interconnecting the buzzer 11 and the transistor 12.

The function of the buzzer driver 10 is to charge the buzzer 11, which works as an inductor element, when the transistor 12 is conducting. When the transistor 12 does not conduct, the inductive element of the buzzer 11 discharges through the diodes 13 and 14. The sound is created by vibration of a membrane on top of the inductor due to this driving. Depending on what frequency is being input to the base or gate of the transistor, a certain tone is produced. The level of sound is determined by the width of the pulses supplied to the gate (or base) of the transistor 12 via a pulse with modulation (PWM) circuit (not shown), as well as the level of the supply voltage $V_{DD}$.

Because the diodes 13 and 14 do not have a significant reverse-bias potential, they develop only approximately 0.6 volts across the buzzer. Unnecessary losses result due to the use of these conventional buzzer diodes. These loses mean that the life of a battery (in a battery operated circuit) is shorter than necessary.

Further, as a consequence of the buzzer potential being reduced is that the level of the output sound is reduced. FIG. 1*a* illustrates the buzzer voltage curve 15 and current curve 16 of the conventional buzzer driver shown in FIG. 1.

OBJECTS AND SUMMARY OF THE INVENTION

One of the objects of the present invention is to provide a circuit wherein the voltage across the buzzer is higher than the conventional design. While this results in the total power consumption to be more or less the same, because the shape of the discharge curve looks different than the conventional buzzer drive circuit, the audio level within various frequency ranges is increased.

A common characteristic of the various embodiments of the invention presented herein is the voltage across the buzzer is relatively higher than in the conventional circuit design.

The present invention achieves advantageous results by rerouting the buzzer discharge. Instead of discharging the stored energy gathered in the buzzer through diodes having low reverse bias potential, it is instead passed through a Zener diode to ground in the first embodiment, for example.

Among the benefits is the removal of unnecessary parasitic capacitances that would otherwise cause losses. Capacitance in the prior art is charged and discharged each time the transistor changes state, which is not a problem in the present invention. The breakdown voltage of the Zener diode controls the peak voltage in the exemplary embodiments which use a Zener diode.

For instance, the present invention achieves these objects with a buzzer circuit which includes a buzzer having a first terminal connected to a power source and a transistor having a first current handling electrode connected at a node to a second terminal of the buzzer and a second current handling electrode connected to ground. The inventive driver circuit further includes a breakdown diode circuit, connected in parallel to the transistor, including at least one breakdown diode, wherein a cathode of the diode is connected to the node between said buzzer and said transistor and an anode of said diode is connected to ground.

The breakdown diode circuit can include a first breakdown diode and second breakdown diode both connected in parallel to the transistor and having a cathode connected at the node to the second terminal of the buzzer and an anode connected to ground.

Alternatively, the breakdown diode circuit can include a series connected first breakdown diode and second breakdown diode, the series connected first and second breakdown diodes being connected in parallel to the transistor and having a cathode connected at the node to the second terminal of the buzzer and an anode connected to ground.

In other embodiments, the buzzer circuit includes a buzzer having a first terminal connected to a power source and a transistor having a first current handling electrode connected at a node to a second terminal of the buzzer and a second current handling electrode connected to ground. In these embodiments, a diode circuit is connected in parallel to the buzzer rather than the transistor. The diode circuit includes a forward biased diode and a reverse biased diode connected in series. The anodes of these diodes are connected together, the cathode of the reversed biased diode is connected to the first terminal of the buzzer and the cathode of the forward biased diode are connected at the node to the second terminal of the buzzer. The forward and reversed biased diodes can be breakdown diodes or light emitting diodes (LEDs).

In still other embodiments, the buzzer circuit includes a buzzer having a first terminal connected to a power source and a transistor having a first current handling electrode connected at a node to a second terminal of the buzzer and a second current handling electrode connected to ground. In these embodiments. instead of diodes, a bidirectional resistor is connected in parallel to the buzzer. A first terminal of the resistor is connected to the first terminal of the buzzer and a second terminal of the resistor is connected to a second terminal of the buzzer.

BRIEF DESCRIPTION OF THE DRAWINGS

The present invention will now be described with reference to specific embodiments illustrated in the accompanying drawings in which.

DETAILED DESCRIPTION OF PREFERRED EMBODIMENTS

The present invention will now be described by reference to several exemplary embodiments, to which the invention is not limited, illustrated in the accompanying drawings.

Figure 2:
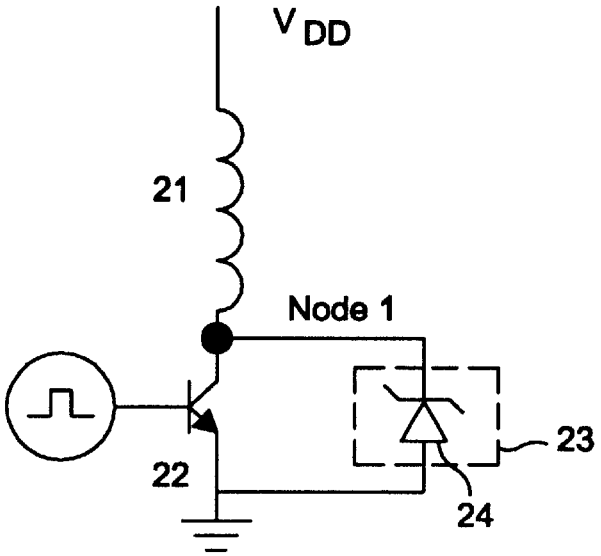
FIG. 2 is a circuit diagram of a first embodiment of the present invention.

As shown in FIG. 2, a first embodiment of the present invention is a buzzer circuit 20 including a buzzer 21 having a first terminal connected to a power source $V_{DD}$ and a transistor 22 having a first current handling electrode connected at a node 1 to a second terminal of the buzzer 21 and a second current handling electrode connected to ground. The buzzer circuit 20 further includes a breakdown diode circuit 23 connected in parallel to the transistor 22. The breakdown diode circuit 23 including at least one breakdown diode 24. A cathode of the breakdown diode 24 is connected to said node between the buzzer 21 and the transistor 22 and an anode of the breakdown diode 24 is connected to ground.

As in the conventional circuit, the function of the buzzer driver 20 is to charge the buzzer 21, which works as an inductor element, when the transistor 22 is conducting. When the transistor 22 does not conduct, the inductive element of the buzzer 21 discharges through the diode circuit 23 to create sound. Depending on what frequency is being developed by the membrane, a certain tone is produced. The level of sound is determined by the width of the pulses supplied to the gate (or base) of the transistor 22 via a pulse with modulation (PWM) circuit (not shown), as well as the level of the supply voltage $V_{DD}$.

The transistor 22 can be a bipolar transistor as illustrated, in which case the first current handling electrode is an emitter and the second current handling electrode is a collector. However, the transistor 22 can be a metal oxide semiconductor field effect transistor, in which case the first current handling electrode is a source and the second current handling electrode is a drain. In either event, the transistor 22 includes a control electrode (gate or base) which receives a pulse width modulated signal.

Figure 2A:
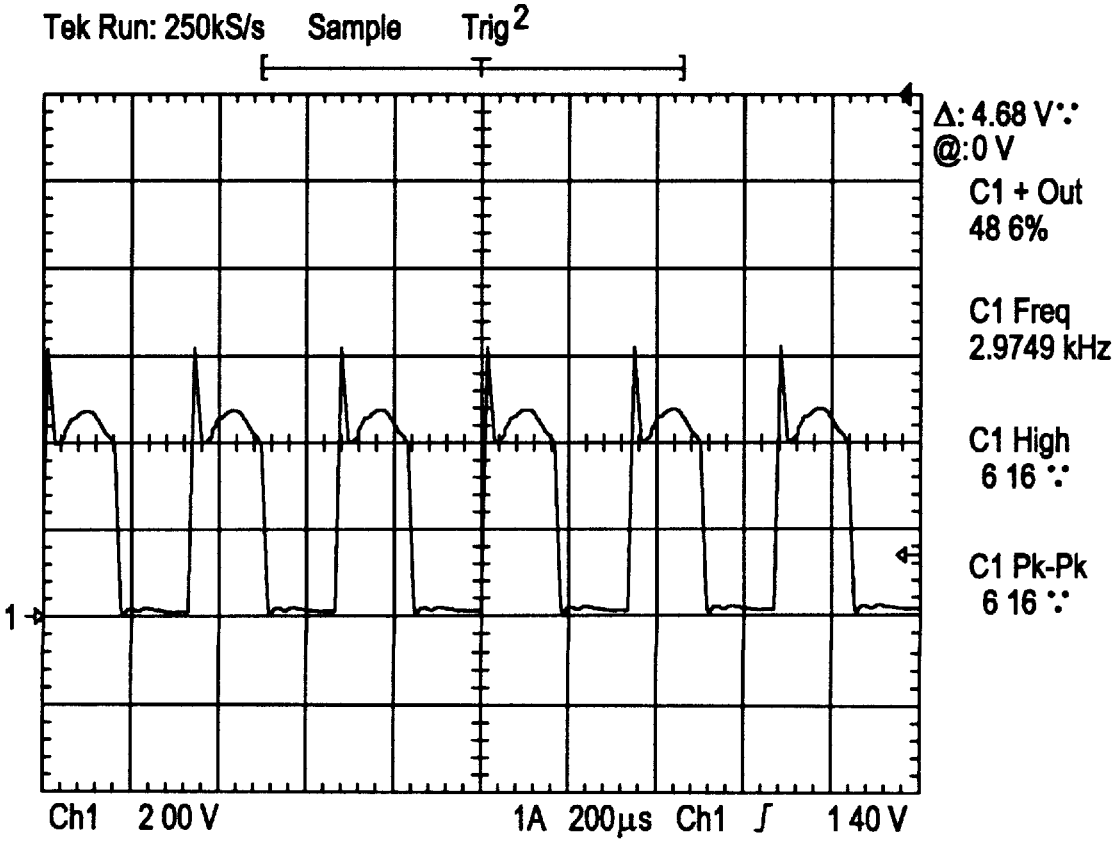
FIG. 2*a* illustrates the buzzer voltage and current curves of the buzzer driver shown in FIG. 2.

The breakdown diode circuit can be as simple as a single Zener diode 24 as shown in FIG. 2. In this instance, when the buzzer 21 is a 3 volt buzzer, the transistor is a bipolar BCW32 sold by Philips Semiconductors™ and the Zener diode is a BZX84C8V2 or BZX84C6V2sold by Fairchild Semiconductors™ the voltage curve of FIG. 2*a* result (wherein FIG. 2*a* has $V_Z$ at 8.2 V).

Figure 3:
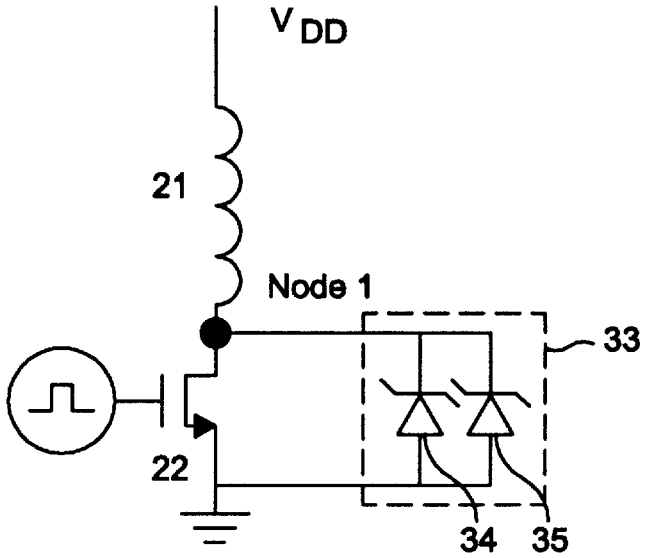
FIG. 3 is a circuit diagram of a second embodiment of the present invention.

However, as shown in FIG. 3 the breakdown diode circuit 33 can include a first breakdown diode 34 and a second breakdown diode 35. Both the first and the second breakdown diodes 34 and 35 are connected in parallel to the transistor 22. Both the first and the second breakdown diodes 34 and 35 have a cathode connected at the node 1 to the second terminal of the buzzer 21 and an anode connected to ground.

Figure 3A:
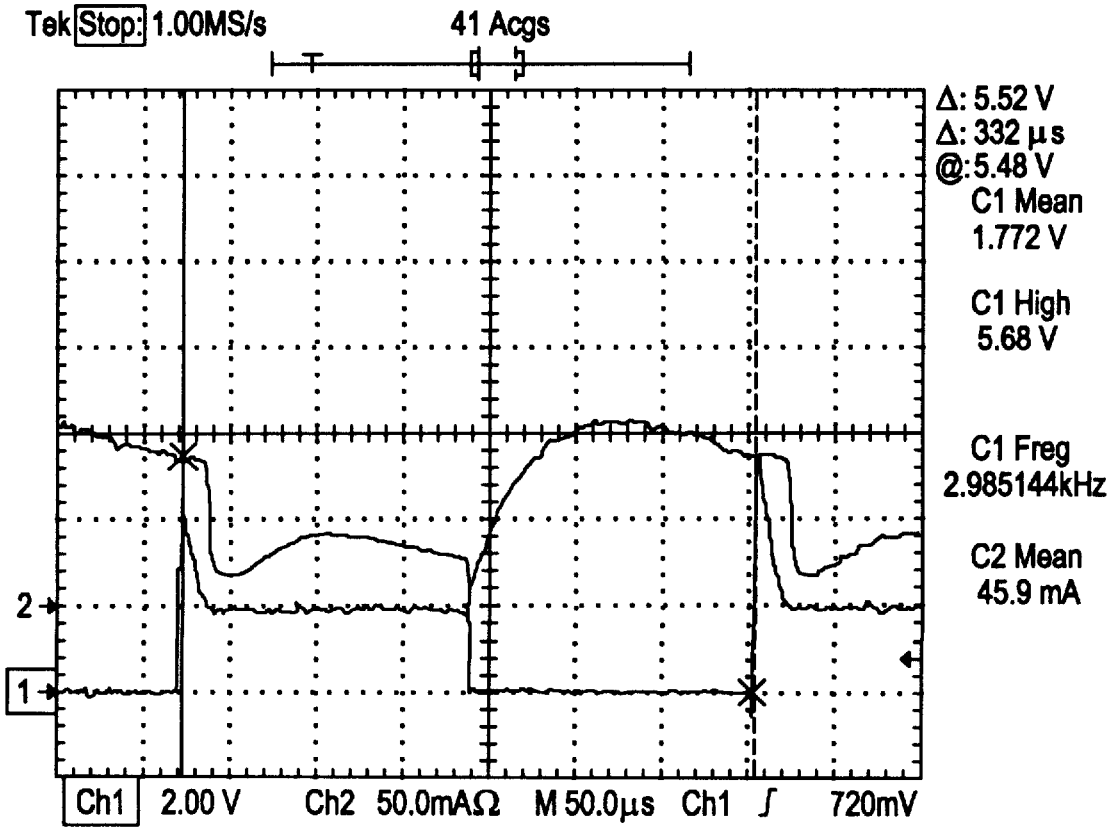
FIG. 3*a* illustrates the buzzer voltage and current curves of the buzzer driver shown in FIG. 3.

As with the first embodiment, the transistor 21 of the second embodiment is protected against over-voltage and transient peaks, which Zener diodes are designed to handle. During the discharge period, constant power is developed and depending on what $V_Z$ of the Zener diode is chosen, the peak voltage across the buzzer 21 varies. The peak voltage becomes wider with a small $V_Z$, which means a lower sound, and becomes narrower peak with a high $V_Z$, which means a higher sound. See FIG. 3*a* and 4*a*, respectively.

A high and narrow peak could affect other adjacent circuitry negatively. However, the applied Zener breakdown voltage is not used to its full extent because it is placed across the transistor 22 and not across the buzzer 21 as in other embodiments. A positive aspect about this embodiment is that is does not use diodes and Zener diodes shunted across the buzzer 21 as in other embodiments, which cause a pointless procedure of charging and discharging their parasitic capacitance. This capacitance consists of two types: A forward biased capacitance (diffusion capacitance) and a reverse biased capacitance (depletion capacitance).

The formulas of them are:

$$CdAq^2L_pP_{no}/(kT)*e^{qV/kT} \text{ and} \qquad \text{equation 1}$$

$$C_j=\sqrt{(q\epsilon_S N_B/2(V_{bi}-V))} \text{ respectively.} \qquad \text{equation 2}$$

wherein A is current, $L_p$ is the lifetime of the minority carriers, $P_{no}$ is the equilibrium hole densities in the n-side, q is the elementary charge, kT is the thermal energy, $\epsilon_s$ is the dielectric constant, $N_B$ is the impurity concentration and $V_B$ is the built-in potential of the substance. The diffusion capacitance in which minority carriers move across the neutral region by diffusion is defined as $Cd=AdQ_pdV$. The depletion capacitance per unit area is defined as $C_j=dQ/dV$, where dQ is the incremental change in depletion layer charge per unit area for an incremental change in the applied voltage dV. (See, S. M. Sze, *Semiconductor Devices: Physics and Technology*, John Wiley & Sons, April 1985). When only Zener diodes are used only the depletion capacitance remains.

Figure 4:
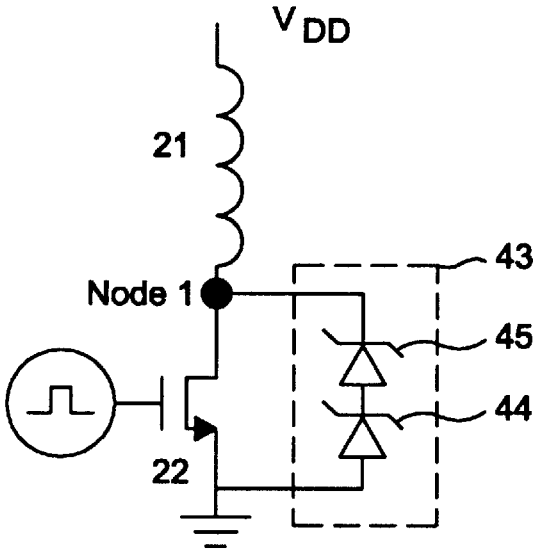
FIG. 4 is a circuit diagram of a third embodiment of the present invention.
Figure 4A:
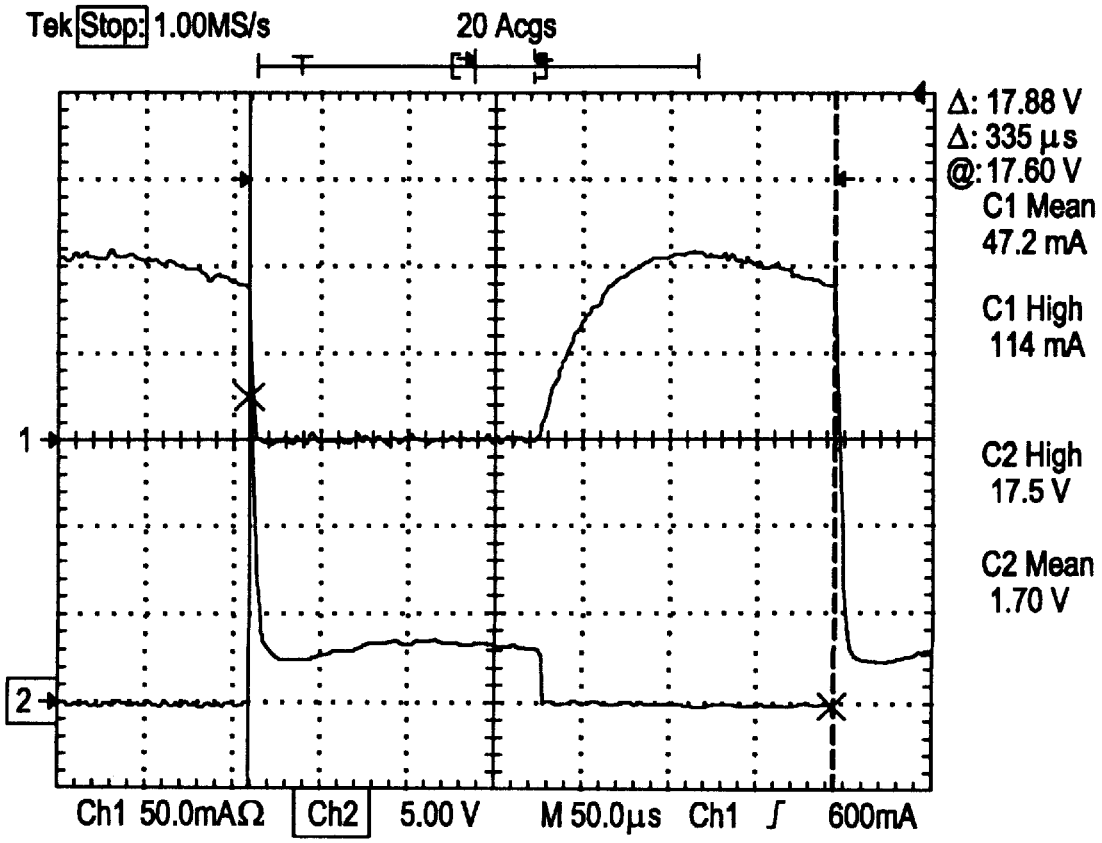
FIG. 4*a* illustrates the buzzer voltage and current curves of the buzzer driver shown in FIG. 4.

Alternatively, as shown in FIG. 4 the breakdown diode circuit 43 can include a series connected first breakdown diode 44 and second breakdown diode 45. The series connected first and second breakdown diodes 44 and 45 are connected in parallel to the transistor 22 and each have a cathode connected at the node 1 to the second terminal of the buzzer 21 and an anode connected to ground. The series connected Zener diodes 44 and 45 greatly increase the voltage across the switching transistor 22, and thereby the sound output as shown in FIG. 4*a*.

Figure 5:
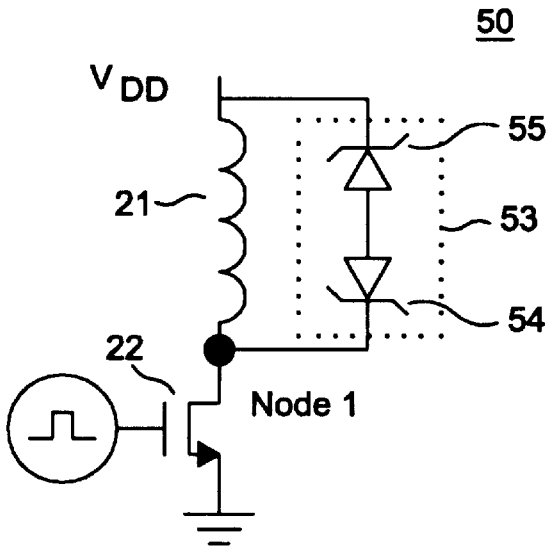
FIG. 5 is a circuit diagram of a fourth embodiment of the present invention.
Figure 6:
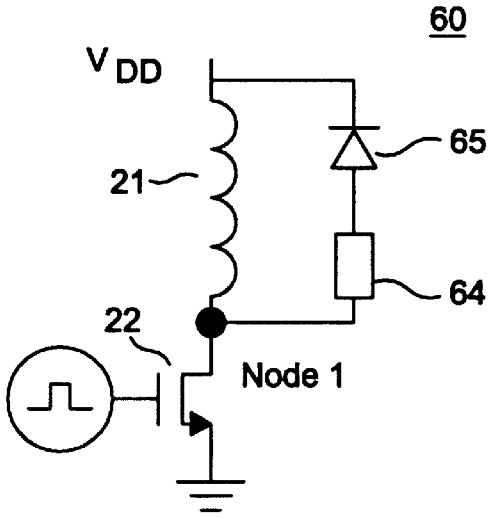
FIG. 6 is a circuit diagram of a fifth embodiment of the present invention.
Figure 6A:
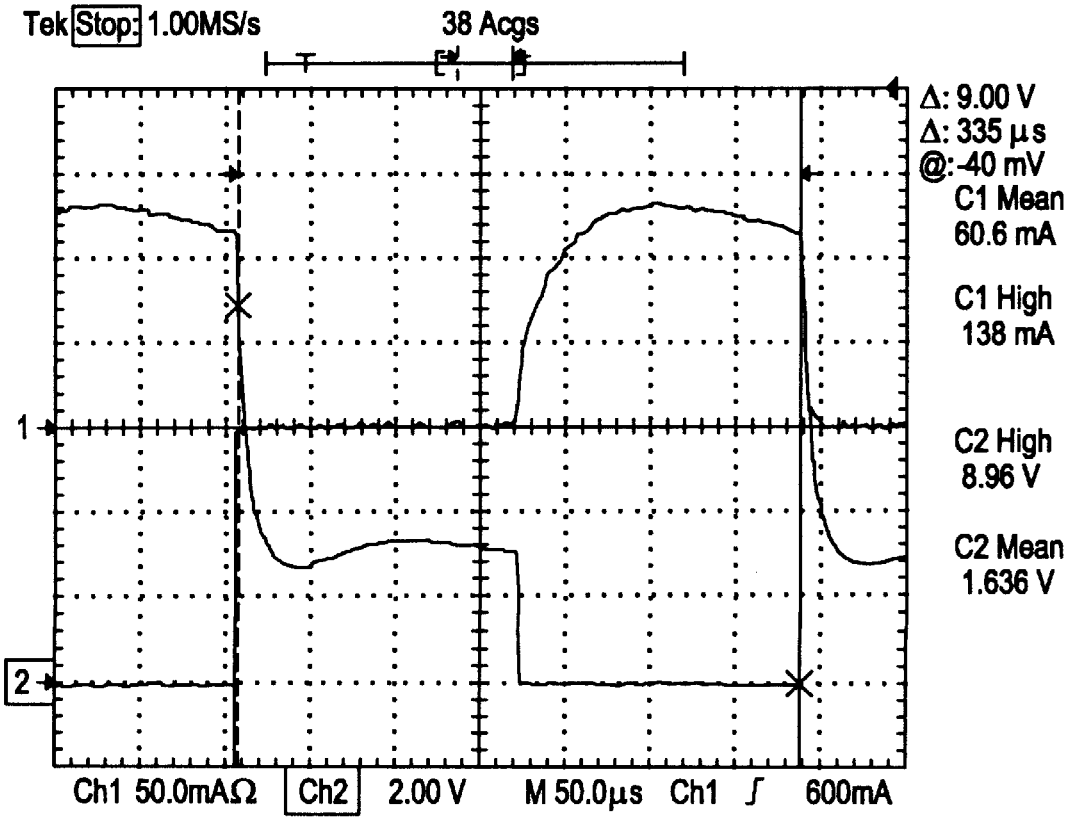
FIG. 6*a* illustrates the buzzer voltage and current curves of the buzzer driver shown in FIG. 6.

FIGS. 5 and 6 illustrate the fourth and fifth embodiment of the present invention wherein an alternative path is provided for the buzzer 21 by shunting resistive elements across the buzzer 21. Specifically, the buzzer circuits 50 and 60 include a buzzer 21 having a first terminal connected to a power source $V_{DD}$ and a transistor 22 having a first current handling electrode connected at a node 1 to a second terminal of the buzzer 21 and a second current handling electrode connected to ground, as with the other embodiments.

In the fourth embodiment shown in FIG. 5, the diode circuit 53 is connected in parallel to the buzzer 1. The diode circuit 53 includes a forward biased diode 54 and a reverse biased diode 55 connected in series. Anodes of these two diodes 54 and 55 are connected together. A cathode of the reversed biased diode 55 is connected to the first terminal of the buzzer and a cathode of the forward biased diode 54 is connected at the node to the second terminal of the buzzer 21.

As in the conventional circuit, the function of the buzzer driver 50 is to charge the buzzer 21, which works as an inductor element, when the transistor 22 is conducting. When the transistor 22 does not conduct, the inductive element of the buzzer 21 discharges through the diode circuit 53 to create sound. Depending on what frequency is being developed by the membrane, a certain tone is produced. The level of sound is determined by the width of the pulses supplied to the gate (or base) of the transistor 22 via a pulse with modulation (PWM) circuit (not shown), as well as the level of the supply voltage $V_{DD}$.

The transistor 22 can be a bipolar transistor as illustrated, in which case the first current handling electrode is an emitter and the second current handling electrode is a collector. However, the transistor 22 can be a metal oxide semiconductor field effect transistor, in which case the first current handling electrode is a source and the second current handling electrode is a drain. In either event, the transistor 22 includes a control electrode (gate or base) which receives a pulse width modulated signal.

As illustrated in FIG. 5, the forward biased diode 54 is a breakdown diode (a Zener diode). The reverse biased diode 55 can also be a Zener diode, but it does not have to be. The reverse biased diode 55 can be a simple diode.

Figure 1:
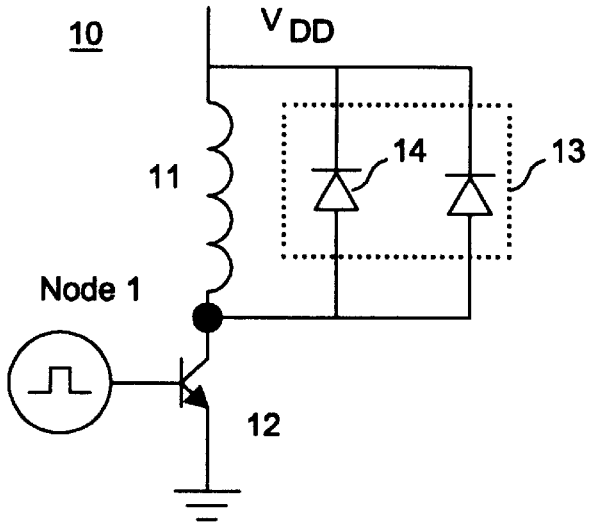
Fig. 1 Prior Art
FIG. 1 illustrates a conventional buzzer driver.
Figure 1A:
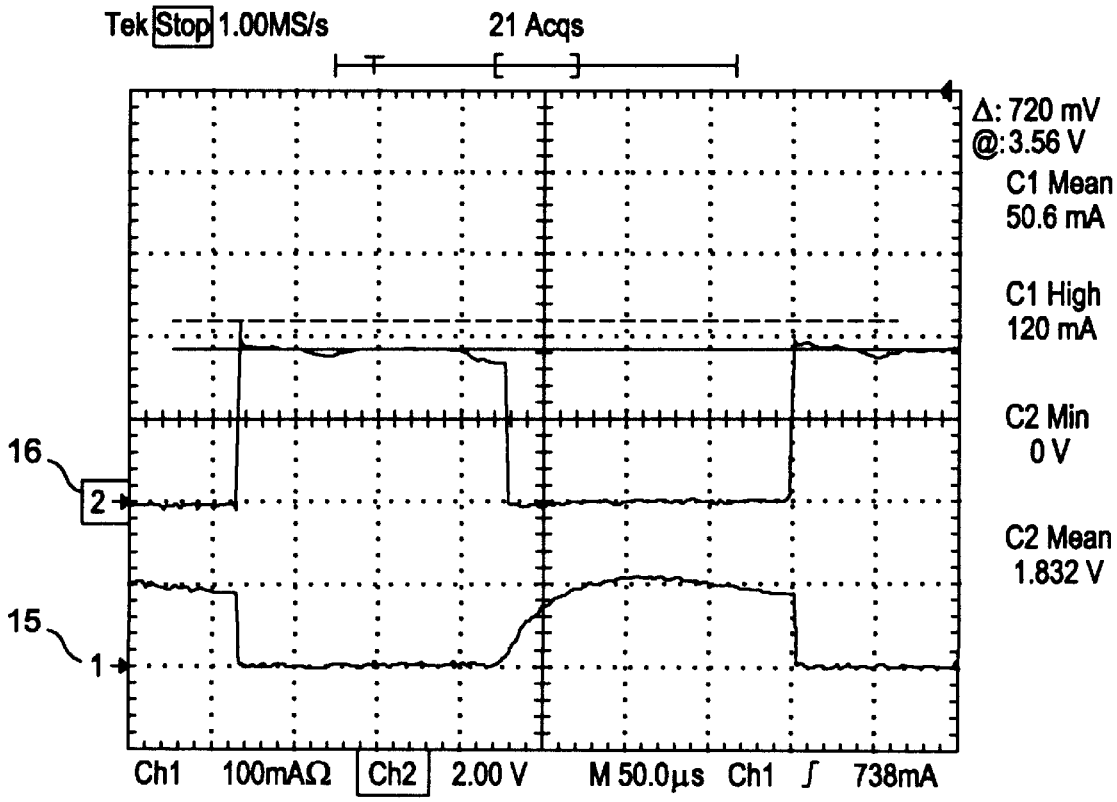
Fig. 1a Prior Art
FIG. 1*a* illustrates the buzzer voltage and current curves of the conventional buzzer driver shown in FIG. 1.
Figure 5A:
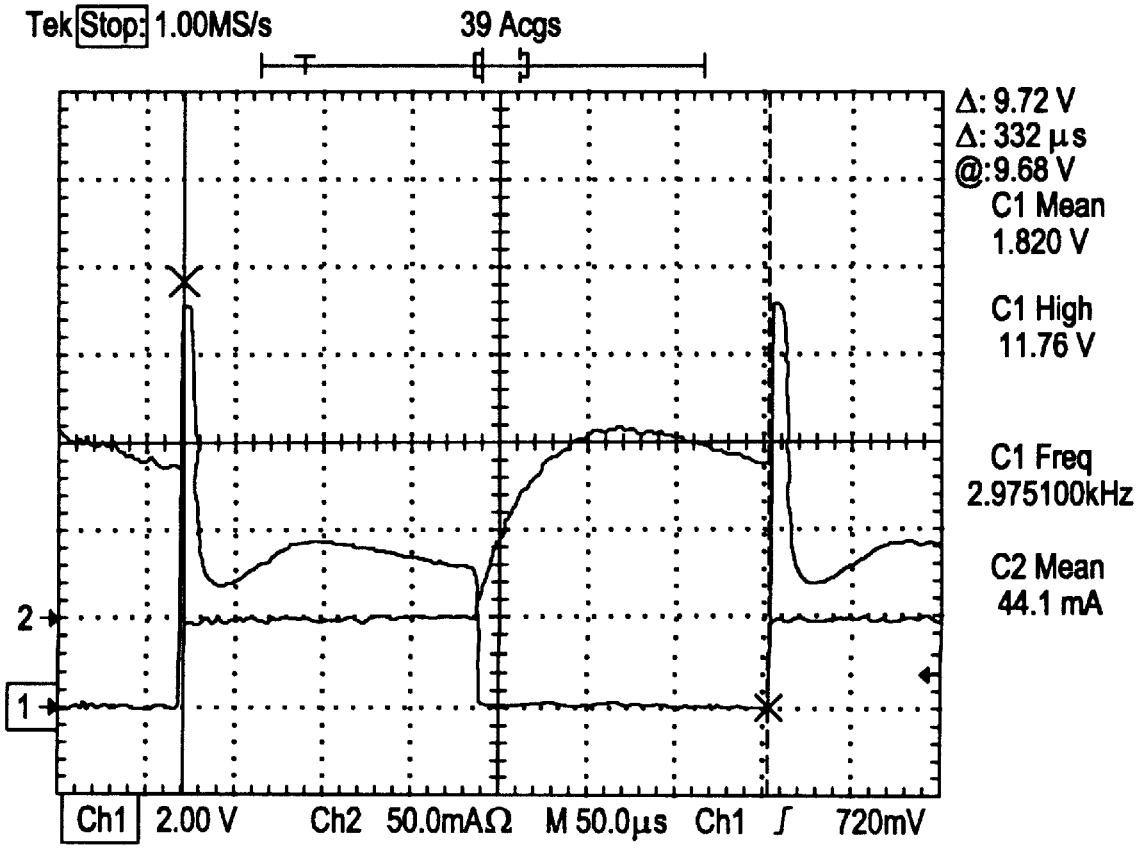
FIGS. 5*a* and 5*b* illustrates the buzzer voltage and current curves of the buzzer driver shown in FIG. 5.

This fourth embodiment shown in FIG. 5 improves the characteristics of the conventional shown in FIG. 1 by letting the diode breakdown voltage, $V_Z$, of the forward biased Zener diode 54 decide the shape of the curve and the voltage, as shown in FIG. 5*a* (with a MOS transistor 21, FDN337 sold by Fairchild Semiconductor™ Zener diodes STZ5.6N sold by Rohm Co., Ltd.™ and a 3 volt buzzer). The reverse biased Zener 55, which can be a simple diode, in FIG. 5 is to block current during buzzer charging.

The result of the diode circuit 53 is a constant peak voltage across the buzzer 21 during its discharging. To vary the audio level, the time the transistor 22 conducts can be changed, i.e., through pulse width modulation. It will broaden/narrow the constant discharge pulse across the buzzer 21.

Figure 5B:
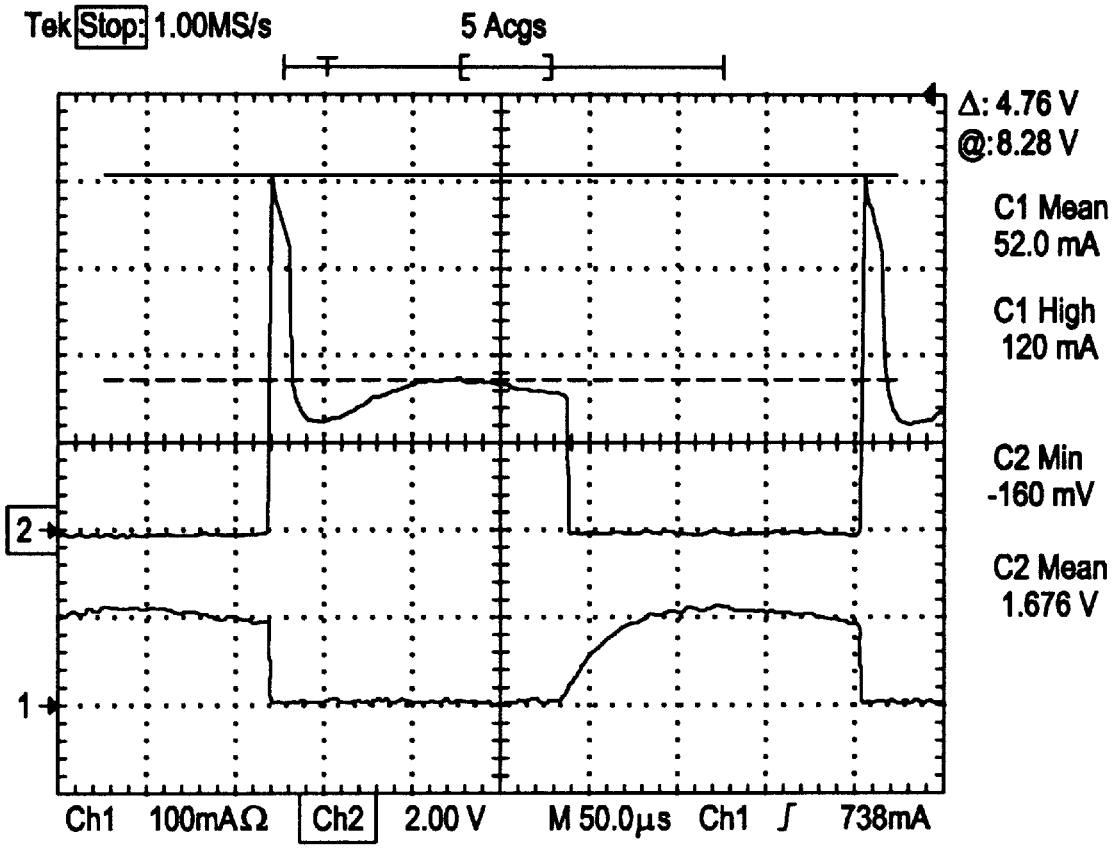

It should be noted that the forward biased diode 54 and or the reversed biased diode 55 can be light emitting diodes. Light emitting diodes (LEDs) can also be used can achieve a higher forward voltage across the buzzer 21. Light emitting diodes are a bit slower than Zener diodes and resistors in changing from reversed biased to forward biased, which causes less harmful peak voltages at the start of discharging. With two LEDs connected in series across the buzzer 21, the curves of FIG.5*b* result. The reversed biased diode 55 can be a breakdown diode.

In the fifth embodiment shown in FIG. 6, the buzzer circuit also includes a buzzer 21 having a first terminal connected to a power source $V_{DD}$ and a transistor having a first current handling electrode connected at a node 1 to a second terminal of the buzzer 21 and a second current handling electrode connected to ground. In this embodiment, the bidirectional resistor 64 is connected in parallel to the buzzer 21. A first terminal of the resistor 64 is connected to the first terminal of the buzzer 21 and a second terminal of the resistor 64 to the second terminal of the buzzer 21.

As in the conventional circuit, the function of the buzzer driver 60 is to charge the buzzer 21, which works as an inductor element, when the transistor 22 is conducting. When the transistor 22 does not conduct, the inductive element of the buzzer 21 discharges through the resistor 64 to create sound. Depending on what frequency is being developed by the membrane, a certain tone is produced. The level of sound is determined by the width of the pulses supplied to the gate (or base) of the transistor 22 via a pulse with modulation (PWM) circuit (not shown), as well as the level of the supply voltage $V_{DD}$.

The transistor 22 can be a bipolar transistor as illustrated, in which case the first current handling electrode is an emitter and the second current handling electrode is a collector. However, the transistor 22 can be a metal oxide semiconductor field effect transistor, in which case the first current handling electrode is a source and the second current handling electrode is a drain. In either event, the transistor 22 includes a control electrode (gate or base) which receives a pulse width modulated signal.

As illustrated in FIG. 6, the buzzer circuit further includes a diode 65 connected in series with the resistor 64 between the first and second terminals of the buzzer 21. With both the resistor 64(R=100 ohm) and the diode 65 in place and as the transistor 22 a FDN337, the curves of FIG. 6 a are obtained.

By using a resistor 64 to increase the voltage over the buzzer 21 a less expensive solution is obtained. Zener diodes are more expensive than resistors. The principle is about the same as in the aforementioned solutions, which means that the voltage is forced to be higher across the buzzer. The diode 65 is there to prevent an increased current consumption. It could, however, be left out.

All of the various embodiments disclosed herein show improvement regarding the sound level compared to the conventional driver of FIG. 1. Also, the present invention offers the additional flexibility of changing the sound level with the hardware. The advantage of the resistor driver (the fifth embodiment), in addition to a higher sound level, is a lower cost compared to the driver of FIG. 1 by replacing the diodes to the resistor.

The disadvantages are a higher voltage transient, which could cause interference with adjacent electronics. However, the MOS transistor/Zener diode combination and the MOS transistor/LEDs show a nicer peak voltage than the others. There is also a slightly higher cost for the three alternatives with Zener diodes and LEDs due to replacement diodes with the Zener diodes or LEDs.

The foregoing exemplary embodiments are illustrative and not limiting of the invention. Doubtless variations and modifications will occur to those skilled in the art without departing from the scope of the present invention as described in the appended claims. For instance, more than the number of circuit components could be used, e.g. exemplary embodiments showing one or two components connected in series or parallel can be embodied with more than two such component connected in series or in parallel.

What is claimed is:

1. A buzzer circuit comprising:

a buzzer having a first terminal connected to a power source;

a transistor having a first current handling electrode connected at a node to a second terminal of said buzzer and a second current handling electrode connected to ground; and a breakdown diode circuit, connected in parallel to said transistor, including at least one breakdown diode wherein a cathode of said diode is connected to said node between said buzzer and said transistor and an anode of said diode is connected to ground, wherein a breakdown value of said breakdown diode circuit is selected to provide a given sound level.

2. A buzzer circuit in accordance with claim 1, wherein said transistor is a bipolar transistor.

3. A buzzer circuit in accordance with claim 1, wherein said transistor is a field effect transistor.

4. A buzzer circuit in accordance with claim 1, wherein said transistor includes a control electrode which receives a pulse width modulated signal.

5. A buzzer circuit in accordance with claim 1, wherein said breakdown diode circuit includes a Zener diode.

6. A buzzer circuit in accordance with claim 1, wherein said breakdown diode circuit includes a first breakdown diode and second breakdown diode both connected in parallel to said transistor and having a cathode connected at said node to said second terminal of said buzzer and an anode connected to ground.

7. A buzzer circuit in accordance with claim 1, wherein said breakdown diode circuit includes a series connected first breakdown diode and second breakdown diode, said series connected first and second breakdown diodes being connected in parallel to said transistor and having a cathode connected at said node to said second terminal of said buzzer and an anode connected to ground.

8. A buzzer circuit comprising:

a buzzer having a first terminal connected to a power source;

a transistor having a first current handling electrode connected at a node to a second terminal of said buzzer and a second current handling electrode connected to ground; and a diode circuit connected in parallel to said buzzer, said diode circuit including a forward biased diode and a reverse biased diode connected in series, anodes of said diodes being connected together, a cathode of said reversed biased diode being connected to said first terminal of said buzzer and a cathode of said forward biased diode being connected at said node to said second terminal of said buzzer.

9. A buzzer circuit in accordance with claim 8, wherein said transistor is a bipolar transistor.

10. A buzzer circuit in accordance with claim 8, wherein said transistor is a field effect transistor.

11. A buzzer circuit in accordance with claim 8, wherein said transistor includes a control electrode which receives a pulse width modulated signal.

12. A buzzer circuit in accordance with claim 8, wherein said forward biased diode is a breakdown diode.

13. A buzzer circuit in accordance with claim 8, wherein said forward biased diode is a light emitting diode.

14. A buzzer circuit in accordance with claim 8, wherein said reversed biased diode is a breakdown diode.

15. A buzzer circuit in accordance with claim 8, wherein said reversed diode is a reversed light emitting diode.

16. A buzzer circuit comprising:

a buzzer having a first terminal connected to a power source;

a transistor having a first current handling electrode connected at a node to a second terminal of said buzzer and a second current handling electrode connected to ground; and a bidirectional resistor connected in parallel to said buzzer, a first terminal of said resistor being connected to said first terminal of said buzzer and a second terminal of said resistor connected to said second terminal of said buzzer.

17. A buzzer circuit in accordance with claim 16, wherein said transistor is a bipolar transistor.

18. A buzzer circuit in accordance with claim 16, wherein said transistor is a field effect transistor.

19. A buzzer circuit in accordance with claim 16, wherein said transistor includes a control electrode which receives a pulse width modulated signal.

20. A buzzer circuit in accordance with claim 16, further including a diode connected in series with said bidirectional resistor between said first and second terminals of said buzzer.

* * * * *